US006316885B1

(12) United States Patent
Collins et al.

(10) Patent No.: US 6,316,885 B1
(45) Date of Patent: Nov. 13, 2001

(54) SINGLE BALLAST FOR POWERING HIGH INTENSITY DISCHARGE LAMPS

(75) Inventors: Byron R. Collins, Tuxedo; Rebecca H. Lancaster, Hendersonville, both of NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/618,743

(22) Filed: Jul. 18, 2000

(51) Int. Cl.[7] ..... H05B 37/02
(52) U.S. Cl. ..... 315/291; 315/209; 315/224
(58) Field of Search ..... 315/291, 224, 315/225, 209 R, 244, 240, 289, 219

(56) References Cited

U.S. PATENT DOCUMENTS

| | | | | |
|---|---|---|---|---|
| 2,417,742 | | 3/1947 | Dosio | 315/223 |
| 3,003,081 | | 10/1961 | Huberty et al. | 315/257 |
| 4,006,384 | | 2/1977 | Elms et al. | 315/323 |
| 4,145,638 | | 3/1979 | Kaneda | 315/244 |
| 4,238,708 | | 12/1980 | Kaneda | 315/289 |
| 4,380,719 | | 4/1983 | De Bijl et al. | 315/244 |
| 4,698,741 | | 10/1987 | Pacholok | 363/131 |
| 5,017,840 | | 5/1991 | Droho | 315/291 |
| 5,608,296 | | 3/1997 | Brown | 315/289 |
| 5,986,412 | | 11/1999 | Collins | 315/291 |
| 6,137,234 | * | 10/2000 | Willaert et al. | 315/209 R |
| 6,150,768 | * | 11/2000 | Nilssen | 315/224 |
| 6,181,066 | * | 1/2001 | Adamson | 315/291 |

OTHER PUBLICATIONS

Electric Discharge Lamps by John F. Waymouth (1971), The Massachusetts Institute of Technology.

* cited by examiner

*Primary Examiner*—Don Wong
*Assistant Examiner*—Wilson Lee
(74) *Attorney, Agent, or Firm*—Fay, Sharpe, Fagan, Minnich & McKee, LLP

(57) ABSTRACT

A ballast circuit for a plurality of serially connected, high pressure gas discharge lamps comprises an electromagnetic ballast arrangement receptive of an input power signal, providing an output ballast voltage for driving the plurality of lamps, and providing an open circuit ballast voltage (OCV) when the lamps are disconnected from the arrangement. An ignitor circuit is connected between the ballast arrangement and the first lamp, and produces at least one ignitor pulse, per each half cycle of the ballast voltage, of high voltage and high frequency compared to the open circuit ballast voltages to initiate starting of the first lamp. A capacitance shunts one of the lamps providing a sufficiently low impedance to a high frequency ignitor pulse so that a substantial portion of the pulse first appears across a non-shunted lamp during lamp starting so as to start the non-shunted lamp and then, when the voltage across the non-shunted lamp falls, to impress a substantial portion of the OCV across the shunted lamp to initiate its starting. When the number of serially connected lamps extends to more than two, the value of each shunting capacitance is selected such that the phase of ignitor pulse is not equal at any two lamps in real time. Furthermore, the shunting capacitance acts to provide a small reignition voltage spike phase shift so that the reignition spikes do not add in real time so as to reduce the required sustaining voltage.

20 Claims, 7 Drawing Sheets

SINGLE BALLAST FOR POWERING HIGH INTENSITY DISCHARGE LAMPS

FIELD OF THE INVENTION

The present invention relates to ballast circuits for powering high pressure gas discharge lamps, and more particularly to a single ballast circuit for powering plural high pressure gas discharge lamps connected in series.

BACKGROUND OF THE INVENTION

A high pressure discharge lamp, such as a metal halide, mercury or high pressure sodium lamp, is typically powered by an electromagnetic ballast circuit incorporating an iron core. The electromagnetic ballast arrangement receives voltage from a power source, and outputs a ballast voltage for driving the lamp. The ballast circuit, which uses the iron core to achieve the necessary voltage adjustment, represents a major component of ballast cost, as well as bulk. The foregoing type of ballast circuit typically suffers the problem of powering only a single high pressure lamp. Existing solutions to more efficiently utilizing a ballast circuit so that it simultaneously powers plural (e.g. dual) high pressure gas discharge lamps sometimes suffer difficulties in starting a wide range of lamps available from various manufacturers. Another problem has been that high pressure discharge lamps undergo physical changes that alter their starting characteristics as they age causing similar difficulties in starting. It would be desirable to utilize a ballast transformer so that it powers plural high pressure discharge lamps, and realizes a considerably reduced per-lamp ballast cost and improved ballast efficiency, while minimizing the above mentioned starting difficulties.

SUMMARY OF THE INVENTION

The invention overcomes the foregoing problem in an exemplary embodiment comprising a ballast circuit for a plurality of serially connected, high pressure gas discharge lamps. The circuit comprises an electromagnetic ballast arrangement receptive of an input power signal, providing an output ballast voltage for driving the plurality of lamps, and providing an open circuit ballast voltage (OCV) when the lamps are disconnected from the arrangement. An ignitor circuit is connected between the ballast arrangement and the first lamp, and produces at least one ignitor pulse, per each half cycle of the ballast voltage, of high voltage and high frequency compared to the open circuit ballast voltage, to initiate starting of the first lamp. A capacitance shunts one of the lamps, providing a sufficiently low impedance to a high frequency ignitor pulse so that a substantial portion of the pulse first appears across a non-shunted lamp during lamp starting so as to ionize the non-shunted lamp, starting a breakdown process, and then, when the voltage across the non-shunted lamp falls, to impress a substantial portion of the OCV across the shunted lamp to initiate its starting. The mentioned capacitance has a value to provide current flow in the non-shunted lamp of sufficient magnitude as to avoid premature lamp degradation due to sputtering of its electrodes when the shunted lamp is not on. The value of the shunting capacitance is selected such that the phase of the ignitor pulse is not equal at any two lamps in real time. Furthermore, the shunting capacitance acts to provide a small reignition voltage spike phase shift during warmup so that the reignition voltages do not add in real time and, therefore, the sustaining voltage does not need to be doubled and the ballast maximum OCV parameter does not need to be doubled.

DETAILED DESCRIPTION OF THE INVENTION

As used throughout this specification and claims, a "shunted" lamp means a lamp across which there exists a shunting capacitance for lamp starting purposes, and a "non-shunted" lamp means a lamp not having across it such a shunting capacitance for starting purposes.

Figure 1:
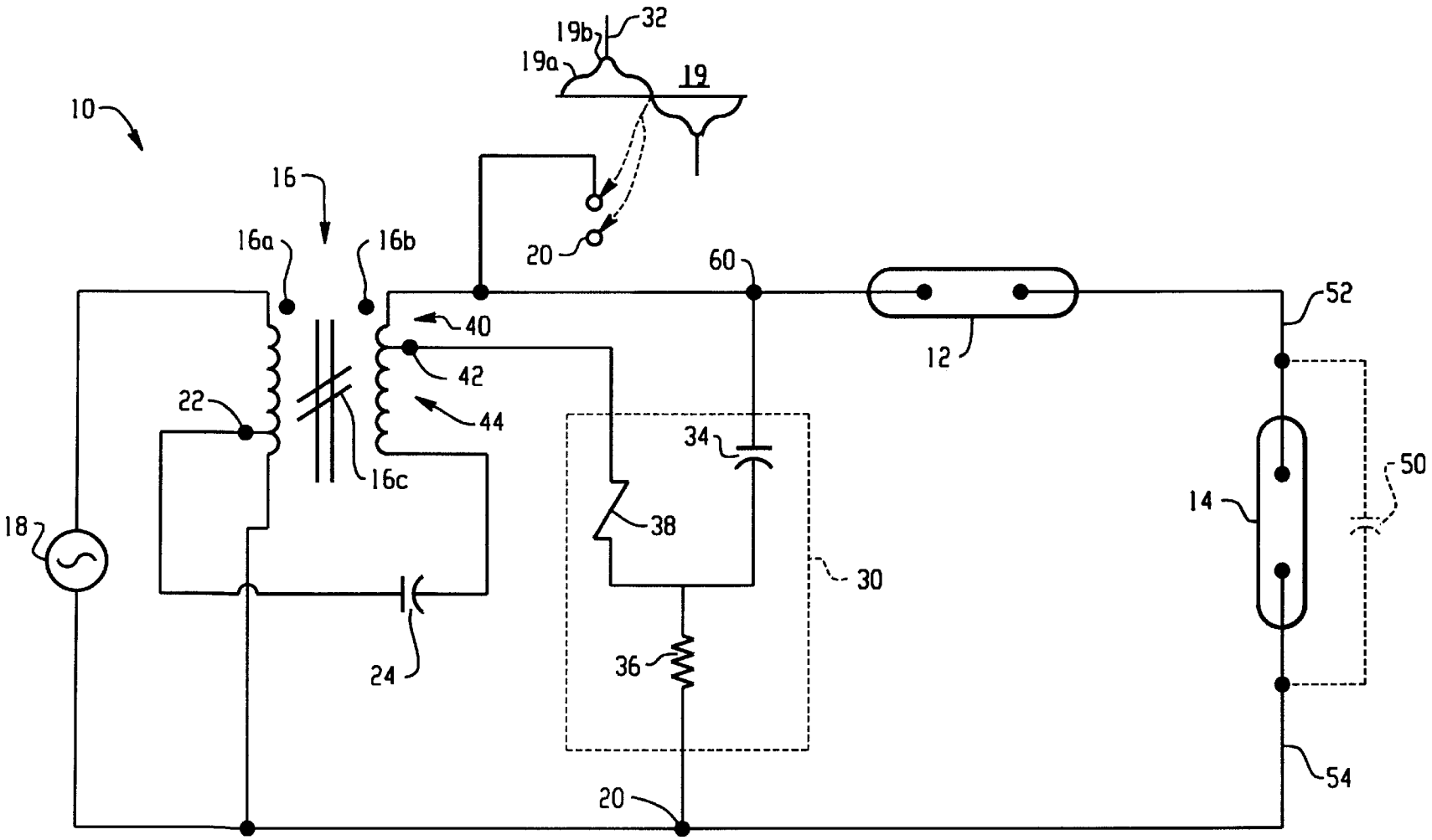
FIG. 1 is a schematic diagram of a single ballast circuit for powering a plurality of high pressure gas discharge lamps, in accordance with the invention.

FIG. 1 shows a ballast circuit 10 for powering high pressure discharge lamps 12 and 14, which are connected in series. Circuit 10 is a constant-wattage autotransformer circuit. A primary winding 16*a* of an electromagnetic (e-m) component 16 receives an a.c. power signal from a source 18, and produces, as an output, a ballast voltage 19 on secondary winding 16*b* with respect to a reference node 20, for driving lamps 12 and 14. E-m component 16 is known as a regulating ballast; its secondary winding 16*b* is tapped into primary winding 16*a* at 22, and its primary and secondary windings 16*a* and 16*b* are shunted as indicated by diagonal lines 16*c*. A ballast capacitor 24 produces a desired phase angle between current and voltage supplied by source 18, and, in combination with e-m component 16. limits current to lamps 12 and 14.

The specific type of e-m component used, however, is not critical to the invention; any other e-m component providing a suitable ballast voltage 19 for driving lamps 12 and 14 may be used, such as a reactor or lag ballast.

For starting lamp 12, ballast circuit 10 includes an ignitor pulse circuit 30 for producing one or more ignitor pulses 32. Of particular interest is the high frequency content of the ignitor pulse 32 with respect to ballast voltage 19. Such high frequency content is referred to herein as a high frequency and high voltage ignitor pulse 32.

Although pulse 32 is shown as positive, on the next negative excursion of ballast voltage 19, pulse 32 would be negative. The particular form of ignitor pulse circuit 30 shown is merely exemplary; many other configurations will be apparent to those of ordinary skill in the art based on this specification.

Circuit 30 includes a capacitor 34, which becomes charged from ballast voltage 19 via a resistor 36. The voltage across capacitor 34 is impressed across the series combination of a voltage-breakover (VBO) device 38 and a number of turns 40 of secondary winding 16*b*, via tap 42. During lamp starting, the voltage on capacitor 34 continues to rise until the similarly increasing voltage across VBO device 38 reaches the breakover voltage rating of such device. Device 38 then rapidly breaks over (i.e., becomes conductive), causing the voltage across capacitor 34 to be impressed directly across secondary winding turns 40. This induces a voltage across the remaining secondary winding turns at tap 42, which adds to the voltage across winding turns 40 and the voltage on ballast capacitor 24, to create ignitor pulse 32 that is high relative to ballast voltage 19.

Figure 2:
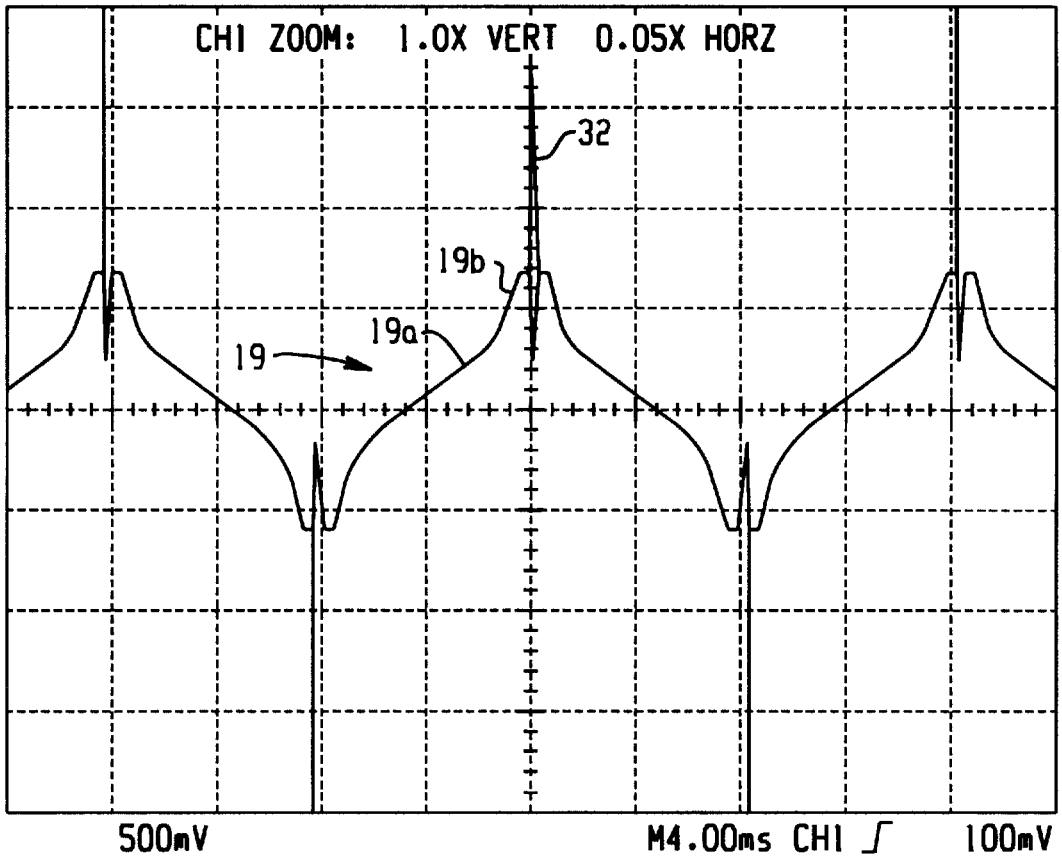
FIG. 2 is an exemplary oscilloscope plot of a CWA ballast waveform with ignitor pulses.

To provide a clear understanding of the aforementioned ballast voltage waveform 19 and ignitor pulse 32, an oscilloscope display of a typical CWA ballast waveform during lamp startup is provided in FIG. 2. In FIG. 2, like numbered reference numerals refer to similar waveform components as shown in FIG. 1. The CWA ballast has a waveform 19 made up of a 60 Hz sine wave fundamental 19*a* with a significant fraction of a third harmonic 19*b* superimposed on the peak of the sine wave wherein the third harmonic forms the peaked part of the waveform 19. Peak component 19*b* is substantially higher in magnitude than the fundamental component 19*a*. Periodic negative-voltage excursions of ballast voltage 19 are typically symmetrical to its positive-voltage excursions.

In this embodiment ignitor pulse 32 would typically be on the order of 2500 volts and would usually be generated at the peak of the open circuit voltage (OCV), approximately at the center of the peaked part of waveform 19. The function of ignitor pulse 32 is to initiate the glow to arc transition and it is usually designed to operate only in the open circuit mode. It should disappear when the lamp starts, and this is accomplished by turning off ignitor pulse circuit 30.

In existing dual lamp systems, testing showed that certain lamps would start reliably at a nominal line voltage, but not as reliably at −10% of the line voltage for 400 watt metal halide type lamps. A concept of the present invention includes increasing the ballast open circuit voltage (OCV) sufficiently to ensure the starting of all lamps connected in series. In existing systems, therefore, where the open circuit voltage would be approximately 372 volts RMS ±10%, the present invention increases the open circuit voltage by approximately 30 volts (i.e. up to a nominal value of 400 volts RMS ±10%, with a peak voltage of about 780 volts). Such an increase ensures proper starting of hard to start lamps. In addition, the ignitor voltage was raised by several hundred volts above existing systems to improve starting reliability.

During lamp starting, voltage ignitor pulse 32 produced by ignitor pulse circuit 30 is impressed across series-connected lamps 12 and 14. lamp 14, however, is shunted by capacitance 50, which is shown in phantom lines for purposes described below. The value of capacitance 50 is chosen such that it appears as a low impedance to pulse 32 of high frequency. The value of capacitance 50 must not, however, be chosen excessively large. Too large of a value for capacitance 50 will result in excessive current through lamp 12 during open circuit operation, causing degradation of lamp 12. Thus there is a limited range of acceptable values for capacitance 50. Too small a value for capacitance 50 and lamp 12 will not start. Too large a value for capacitance 50 and lamp 12 will suffer degradation due to sputtering of its electrodes in the event that lamp 14 is removed or inoperative. As is known, the impedance of a capacitor to an a.c. current is $1/(2\pi fc)$, where f is the frequency of the current, and c is the capacitance in farads. For the specific example implemented in FIG. 1 as set forth below, pulse 32 has a frequency fundamental of about 20 kHz, as compared with a typical frequency of ballast voltage 19 of 60 hertz. In such case, shunting capacitance 50 may then be from about 2500 to 6000 picofarads (i.e. where 3900 picofarads are used in a preferred embodiment), resulting in an impedance for capacitance 50 of about 2000 ohms in this example. In comparison to the impedance of non-started lamp 12, at the high frequency of pulse 32, the impedance of capacitance 50 is low.

With shunting capacitance 50 appearing as a low impedance to pulse 32, a substantial portion, in one example up to ¾, of the pulse voltage appears across the non-shunted lamp 12. The pulse acts to reduce the glow voltage of lamp 12 enough so that more than half of the OCV appears across lamp 14. This causes a breakdown in the gaseous fill within non-shunted lamp 12. For metal halide lamps made according to the specific example for implementing FIG. 1 set forth, the lamp voltage typically drops from about 200 volts in the glow mode to about 20–30 volts upon completing a glow-to-arc transition, and then rises in voltage to a steady state operating level of about 135 volts.

During the same or a subsequent ignitor pulse 32, when, as mentioned, the voltage across lamp 12 has fallen considerably, a substantial portion of the open circuit voltage is consequently impressed across lamp 14, which then transitions from a glow-to-arc mode as was the case with lamp 12. It is preferred that lamp 14 initiate its startup process during the same pulse 32 as the first lamp because the ionization condition in lamp 12 quickly reverses itself unless it is quickly reinforced by either turn-on of lamp 14 or a closely following ignitor pulse. It is important, however, that capacitance 50 be sufficiently large in value to provide adequate phase shifting of ignitor pulse 32 so that pulse 32 appears on lamp 14 after appearing on lamp 12, rather than essentially simultaneously in real time in which case the voltage of peak component 19*b* would be insufficient to start lamps 12 and 14 simultaneously. The exact amount of phase shift provided will depend on the voltage and component values of individual systems. It is to be appreciated that, while capacitor 50 was used in the embodiment of the present invention shown in FIG. 1, other means of phase shifting may be employed in the present invention.

When shunted lamps 12 and 14 turn on, series lamp voltage falls considerably. With the series voltage across lamps 12 and 14 being considerably less than before they started, insufficient voltage is available to breakover device 38 of ignitor circuit 30 to cause it to conduct. Starting capacitor 34 is thus prevented from discharging through turns 40 of secondary winding 16*b* via device 38. Consequently, when lamps 12 and 14 are operating, ignitor circuit 30 is automatically disabled from creating further ignitor pulses.

In a specific example of implementing the ballast circuit of FIG. 1, the following component values may be used for a pair of 135 volt, 400 watt metal halide lamps, wherein polarities of transformer windings are indicated by dots in FIG. 1:

| | |
|---|---|
| Ballast capacitor 24 | 18 microfarads |
| Ballast voltage 19 | 781 volts peak |
| Number of turns 40 of secondary winding 16b | 47 |
| Number of turns 44 of secondary winding 16b | 423 |

-continued

| | |
|---|---|
| Starting capacitor 34 | .16 microfarads |
| Resistor 36 | 20 k ohms |
| Shunting capacitance 50 | 3900 picofarads |

Electromagnetic (c-m) component 16 is a ballast providing 3.2 amps lamp current for 400 watt metal halide lamps, and voltage-breakover device 38 includes one or more serially connected SIDACS having a total breakover voltage of 225 volts, such as available part number KIV24 from Shidengen Electric Mfg. Co. Ltd. of Tokyo, Japan.

Figure 3:
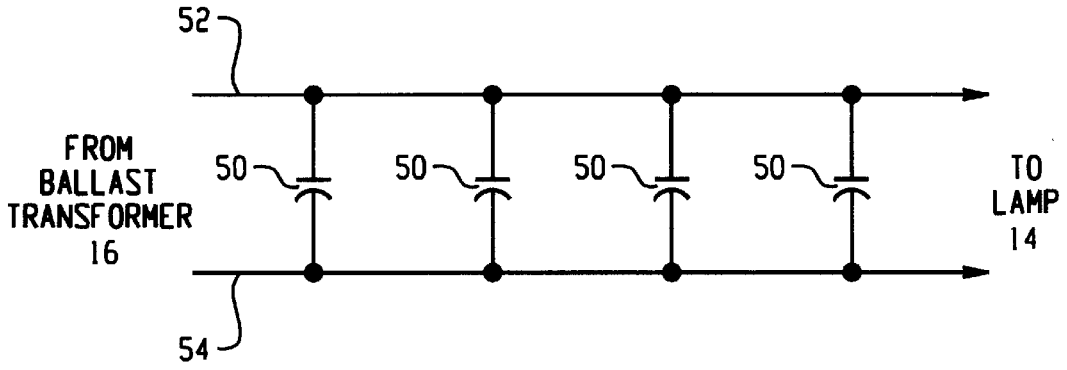
FIG. 3 is a detail view showing, between power-carrying conductors leading to a shunted lamp, a distributed capacitance that can be used in lieu of a discrete capacitor in some embodiments of the invention.

The mentioned value of shunting capacitance 50 can be realized partially, 10% for example, by distributed capacitance if the power-carrying conductors leading to shunted lamp 14 are sufficiently long. Thus, referring to FIG. 3, if power-carrying conductors 52 and 54 leading to lamp 14 are at least about 20 feet long, and in a grounded conduit, for the above mentioned specific example of implementing FIG. 1, the distributed capacitance 50 between conductors 52 and 54 is typically 200–300 picofarads, and the specified value of capacitance 50 in the above mentioned example can be reduced by 200–300 picofarads. If power-carrying conductors 52 and 54 are sufficiently long or consist of a twisted pair such that the capacitance is at least 2500 picofarads in the above mentioned example, all of the shunting capacitance can be provided by distributed capacitance and a discrete capacitor is not needed to form capacitance 50.

High pressure discharge lamps other than metal halide lamps as described in the above example for implementing FIG. 1 can be used. The high pressure discharge lamps can be of high intensity metal halide lamps, high pressure mercury lamps, or even a high pressure sodium (HPS) lamp for which a limited dose is provided. In order to most reliably benefit from the present invention, however, a high pressure gas discharge lamp should have a reasonably constant operating voltage over its lifetime. Because the same current flows through all serially connected lamps, the respective wattages of the lamps are strongly dependent on their respective operating voltages. Essentially, such operating voltages should not vary so greatly over the lifetime of the lamps that the respective wattages of the lamps vary into undesired (e.g. out-of-rated) ranges. It is most preferred that such lamp operating voltage be maintained to within about 15–20 percent of a nominal value, although, depending on ballast capacity, more variation can be tolerated.

Within the foregoing general constraint of lamp operating voltage being reasonably constant, a series of lamps powered in accordance with the invention can be of mixed variety, e.g. a metal halide lamp connected to a mercury lamp. By way of example. limited dose high pressure sodium lamps also typically have a reasonably constant operating voltage.

Figure 4:
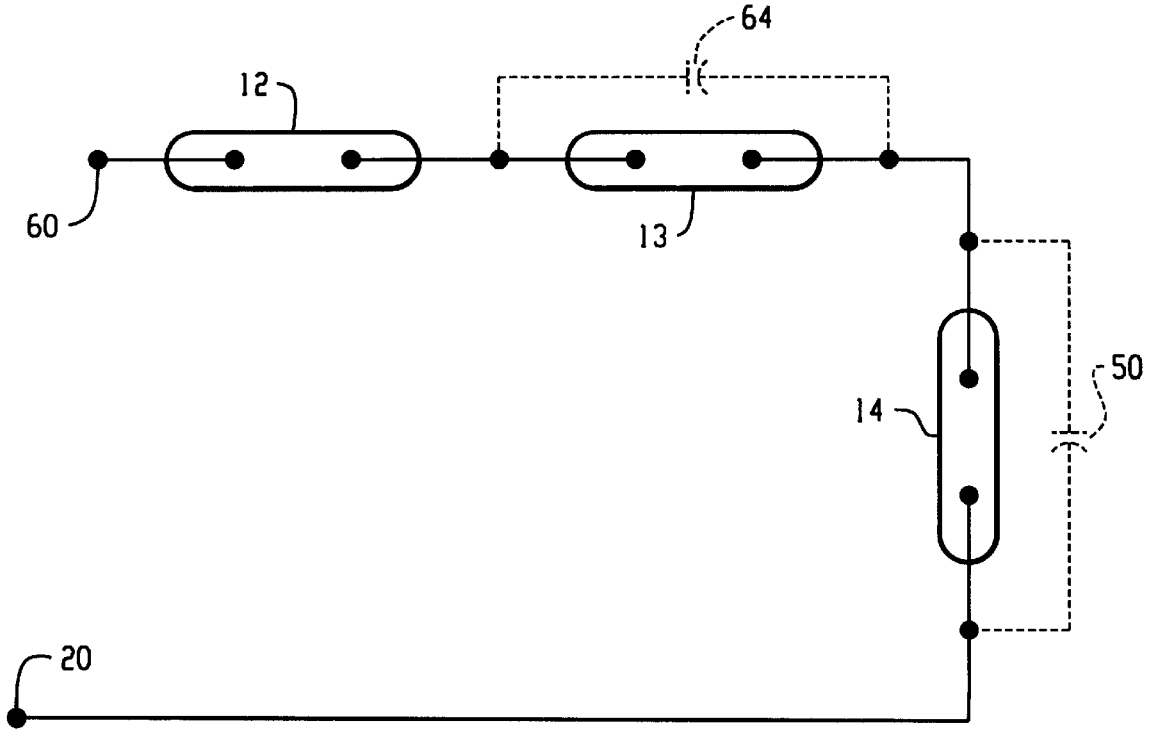
FIG. 4 shows a substitute circuit to the right of nodes 60 and 20 in FIG. 1 with three lamps connected in series.

FIG. 4 shows a substitute circuit to the right of nodes 60 and 20 in FIG. 1. The circuit of FIG. 4 contains three serially connected, high pressure gas discharge lamps 12, 13 and 14. Lamp 14 is shunted by capacitance 50, while lamp 12 is non-shunted, as was the case in FIG. 1. A third lamp 13. not shown in FIG. 1, is serially connected to lamps 12 and 14, the order of such serial connections not being important. Shunted across lamp 13 is a capacitance 64 which differs in value from capacitance 50. Shunting capacitances 50 and 64 are selected such that the phase of the ignitor pulse 32 at each of the lamps 12, 13 and 14 is different than at any of the remaining lamps, such that the voltage peaks across each of said lamps do not add together in real time. In this way, each of lamps 12, 13 and 14 will start in order of increasing capacitance, with lamp 12 starting before any of the remaining lamps.

After initial startup of lamps 12 and 14 has begun, but during a warmup period of the lamps, solid mercuric iodide which was present in the cold lamps starts to vaporize and form what is known as an electron-attaching gas. The presence of an electron-attaching gas presents an additional problem during the warmup period. When an electron becomes attached to a mercuric iodide molecule through dissociative electron capture, the electron becomes lost to what is known as an electron avalanche. The electron avalanche is a process where free electrons in the lamps are supplied with sufficient energy by the electric fields present in the lamps to produce ions and free electrons through collisions with other atoms in the lamps, thus filling the lamps with an ionized gas and enough free electrons necessary to sustain an arc. The positively charged ions are too massive to be accelerated enough to contribute to the generation of additional ions and free electrons. Because the lamp current goes through zero every half cycle, the lamps need to be restarted on each half cycle, and the presence of the ionized gas and free electrons makes this possible. If there were no ionized gas present in the lamps, it would take thousands of volts to restart the lamp arc on each half cycle. The presence of mercuric iodide during warmup however, removes enough electrons at the start of each half cycle that there is initially no gain and no increase in the number of free electrons which gives rise to reignition spikes. A significant sustaining voltage is required because of the reignition spikes, however, the phase shifting provided by capacitance 50 is effective in reducing the amount of sustaining voltage required because the reignition spikes on lamps 12 and 14 are sequential and cannot add together in real time. Sustaining voltage is the instantaneous voltage available to the lamps from the ballast at the time the lamp current passes through zero.

Figure 5:
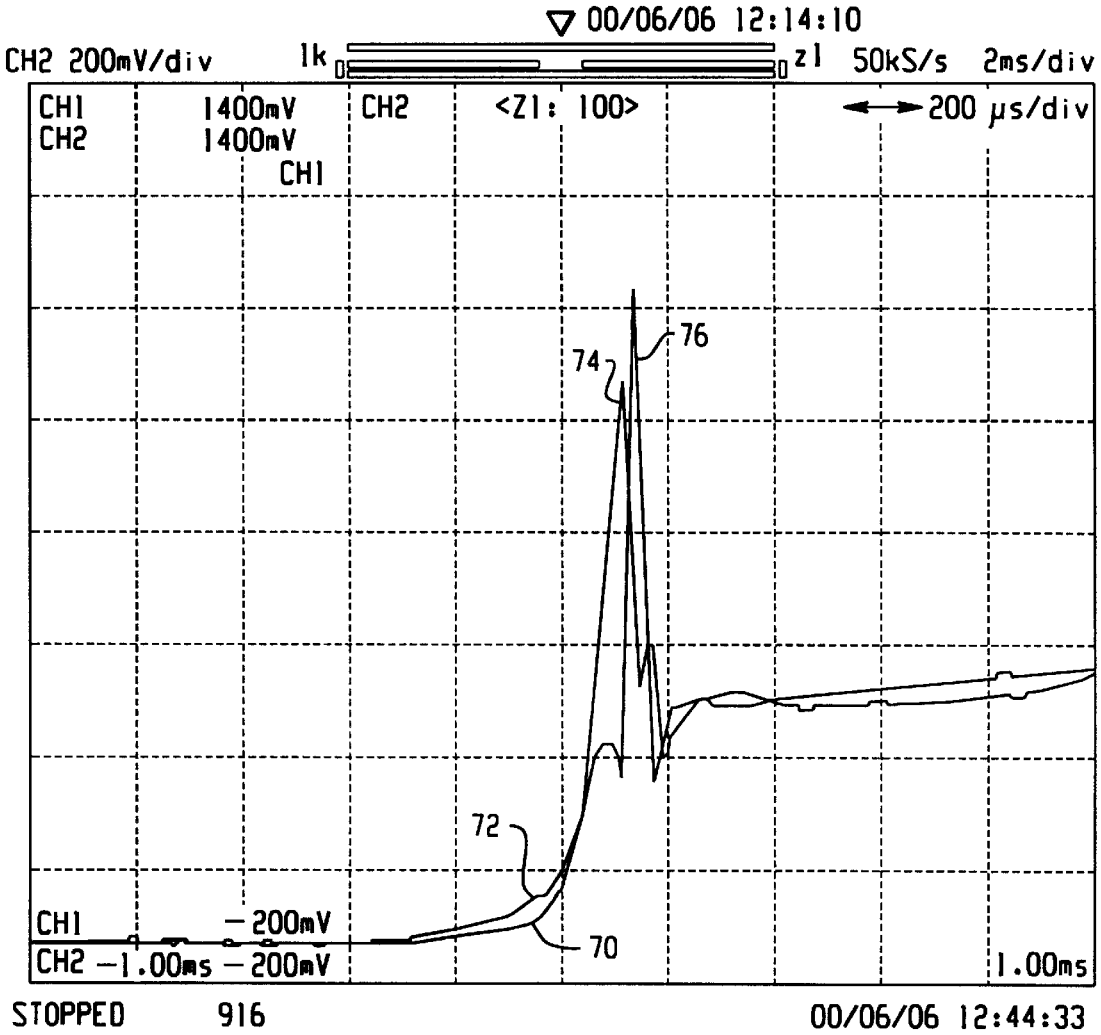
FIG. 5 is an oscilloscope plot showing reignition spikes for serially connected GE lamps on a GE Twinlite ballast with a capacitor installed on the second lamp.
Figure 6:
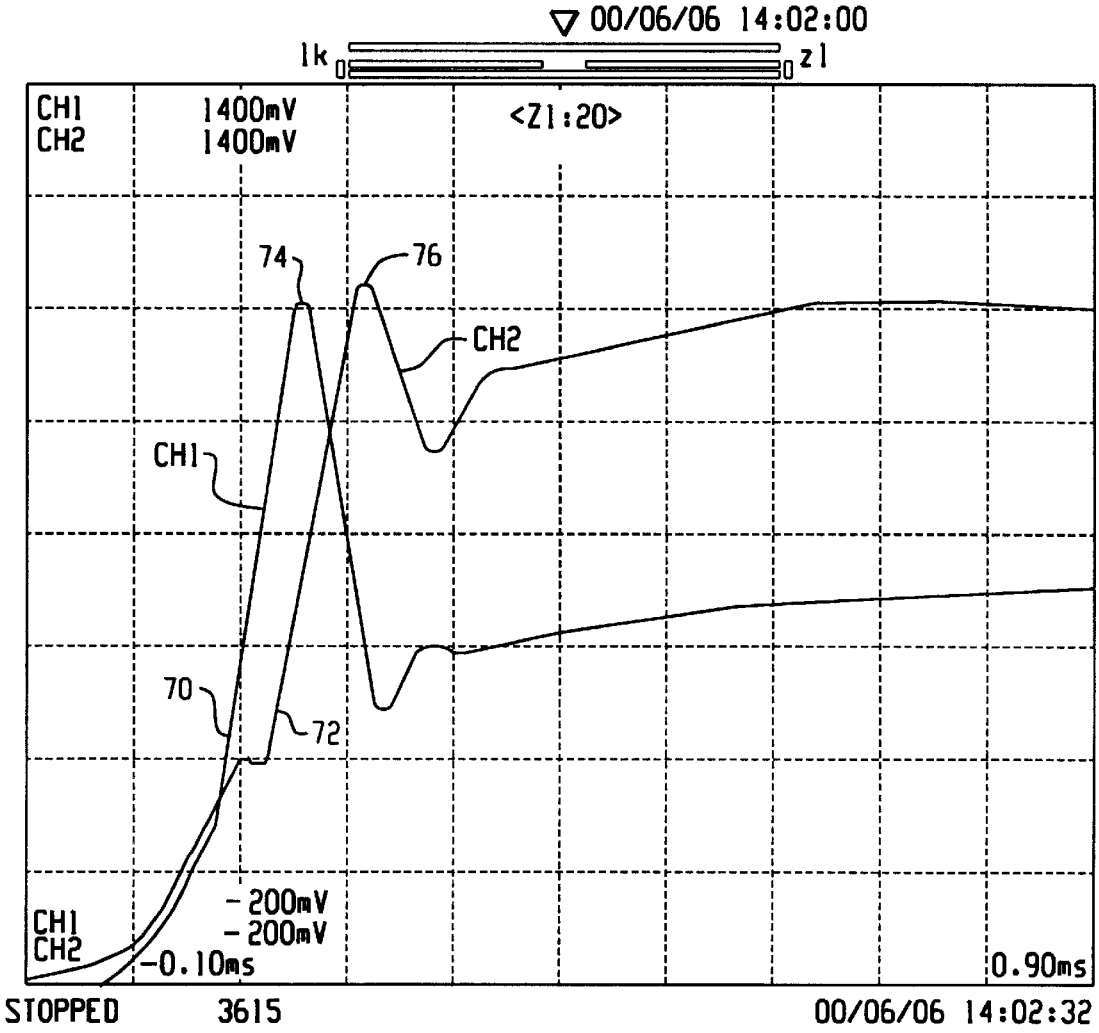
FIG. 6 is an oscilloscope plot showing reignition spikes for serially connected OSRAM lamps on a GE Twinlite ballast with a capacitor installed on the second lamp.

An example of such reignition spikes is shown in FIG. 5, where exemplary reignition voltage waveforms for two serially connected GE lamps on a GE Twinlite ballast are shown. Waveform 70 is the voltage seen by the first lamp 12 (master) which has no capacitor, and waveform 72 is the voltage seen by the second lamp 14 (satellite) which has a capacitor 50 installed across its terminals. It can be readily observed that OCV components consisting of reignition spikes 74 and 76 do not occur simultaneously in real time because of the phase shifting effect of capacitor 50, and that spike 76 is slightly delayed compared to spike 74 so that the reignition voltages of the lamps do not add together and exceed the maximum OCV of the ballast. Additional exemplary reignition voltage waveforms are provided in FIG. 6 using the same configuration as FIG. 5, however, both lamps were Sylvania M400/U lamps. Again, it can be seen that reignition spike 76 is slightly delayed compared to spike 74 so that the reignition voltages of the lamps do not add together and exceed the maximum sustaining voltage of the ballast. After warmup, at 60 Hz, the voltage climbs relatively slowly at the start of each half cycle and significant deionization occurs during the millisecond or so that the lamps take to restart. This gives the lamp operating voltage the characteristic hump at the start of each half cycle, however, reignition spikes 74 and 76 may not be present. If the frequency is increased, then the hump magnitude and width decrease. If the frequency is decreased, then the hump will get higher.

Figure 7:
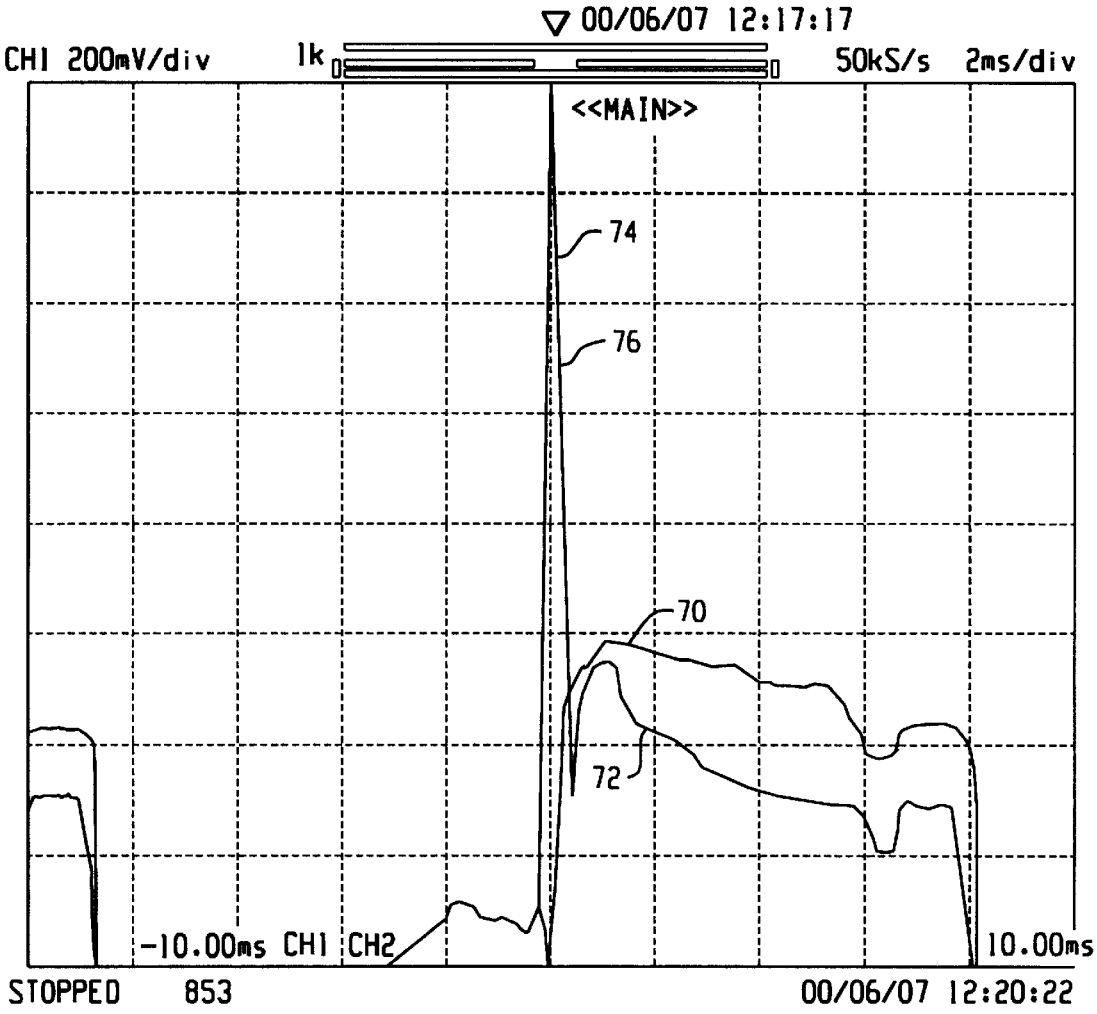
FIG. 7 is an oscilloscope plot showing reignition spikes for serially connected GE lamps on a GE Twinlite ballast with no capacitor installed; and, FIG. 8 is an oscilloscope plot showing multiple reignition spikes for a normal lamp connected to a CWA ballast.
Figure 8:
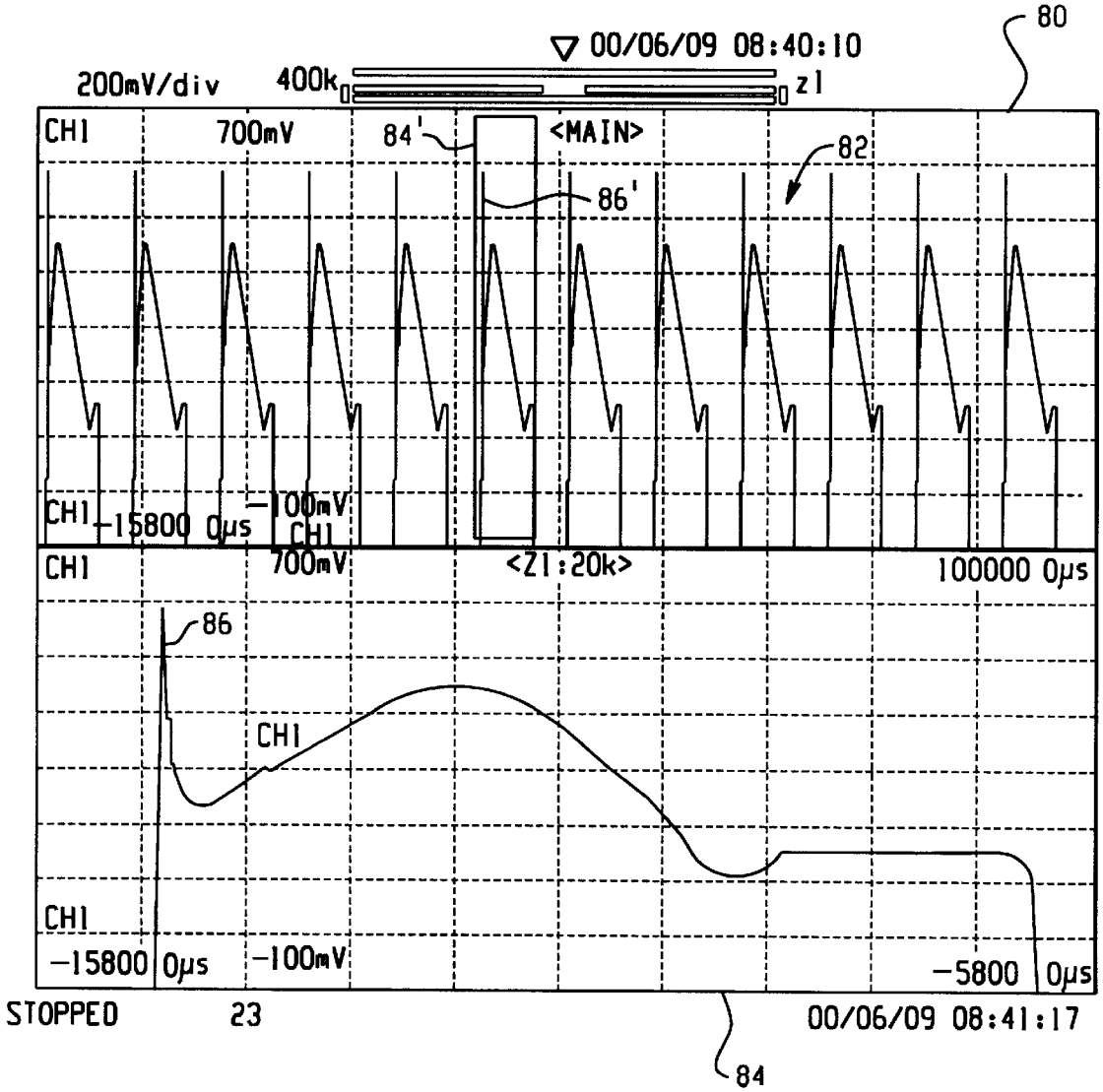

To demonstrate the effectiveness of capacitor 50 installed on satellite lamp 14, the same configuration as FIG. 5 was repeated in FIG. 7 with capacitor 50 removed. Reignition spikes 74 and 76 occur essentially simultaneously in this configuration, causing much larger excursions of the reignition voltage waveforms. The potential of having two lamps whose total series reignition voltage requirement exceeds the sustaining voltage of the ballast is greatly increased, in which case the lamps would be extinguished. FIG. 8 further illustrates the effectiveness of capacitor 50. A single lamp was connected to a CWA ballast for this test to illustrate typical lamp voltage waveforms on a standard single lamp installation. The upper portion 80 of FIG. 8 shows sequential reignition spikes 82 on the single lamp while the lower portion 84 shows a single reignition spike 86 corresponding to spike 86' in upper portion 80. The reignition spike voltage is similar in magnitude to those observed in FIGS. 5 and 6, demonstrating that the operating voltages for serially connected lamps 12 and 14 with capacitor 50 installed are essentially similar to a single normal lamp operating on a standard CWA ballast.

The effectiveness of the present invention in reducing the maximum sustaining voltage requirement of the ballast for serially connected lamps is an advantage when applied to lamps that are known to be "bad" or hard to start. The aforementioned lamps are less likely to extinguish during warmup because the reignition spikes do not occur simultaneously at more than one lamp in real time.

The principles of the invention extend even beyond the starting of three serially connected lamps, with capacitive shunting of different impedances being used on all but one lamp to ensure that a phase shift exists for the ignitor pulse of each lamp, such that no two lamps have essentially the same phase relationship in real time.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit for at least two serially connected, high pressure gas discharge lamps, the circuit comprising:

an electromagnetic ballast arrangement receptive of an input power signal, providing an output ballast voltage for driving said lamps during steady state operation of said lamps, providing an open circuit ballast voltage (OCV) when said lamps are disconnected from said arrangement;

an ignitor circuit for producing at least one ignitor pulse of high voltage and high frequency with respect to said open circuit ballast voltage, to initiate lamp starting;

a non-shunted lamp of the at least two lamps; and at least one capacitance shunting the at least one remaining lamp providing a sufficiently low impedance to a high frequency ignitor pulse that a substantial portion of said pulse first appears across a non-shunted lamp during lamp starting so as to start said non-shunted lamp and then, when the voltage across said non-shunted lamp falls, to impress a substantial portion of the OCV across said shunted lamp to initiate its starting, wherein the at least one capacitance is selected such that the phase of the ignitor pulse at the at least one remaining lamp is different from the non-shunted lamp such that the voltage peaks across each of said lamps do not add together in real time.

2. The ballast circuit of claim 1, wherein more than about 10% of said shunting capacitance across a lamp comprises the distributed capacitance between power-carrying conductors leading to said shunted lamp for powering said lamp.

3. The ballast circuit of claim 1, wherein substantially all of said shunting capacitance across a lamp comprises the distributed capacitance between power-carrying conductors leading to said shunted lamp for powering said lamp.

4. The ballast circuit of claim 1, wherein said high pressure lamps comprise at least one of, a metal halide lamp, a mercury lamp and a limited dose sodium lamp.

5. The ballast circuit of claim 1, wherein said ignitor circuit is so constructed as to produce an ignitor pulse of sufficient intensity and frequency that all of said serially connected lamps start on the same ignitor pulse.

6. The ballast circuit of claim 1, wherein said shunting capacitance is between 2500 picofarads and 6000 picofarads.

7. The ballast circuit of claim 1, wherein the open circuit voltage has a 400 volt RMS nominal rating ±10%.

8. The ballast circuit of claim 1 wherein the capacitance has a value sufficiently low to prevent current flow in the non-shunted lamp of sufficient magnitude as would cause premature lamp degradation due to sputtering of its electrodes when said shunted lamp is not on.

9. The ballast circuit of claim 1 wherein the at least one remaining lamp is a plurality of remaining lamps; and, wherein the at least one capacitance is a plurality of capacitances.

10. The ballast circuit of claim 1 wherein each of the capacitances is selected such that the phase of the ignitor pulse at each of the remaining lamps is different from any of the remaining lamps such that the voltage peaks across each of said lamps do not add together in real time.

11. A ballast circuit for a plurality of serially connected, high pressure gas discharge lamps the circuit comprising:

an electromagnetic ballast arrangement receptive of an input power signal, providing an output ballast voltage for driving said plurality of lamps during steady state operation of said lamps, and providing an open circuit ballast voltage when said lamps are disconnected from said arrangement;

an ignitor circuit for producing at least one ignitor pulse of high voltage and high frequency with respect to said open circuit ballast voltage, to initiate lamp starting;

a non-shunted lamp; and at least one capacitance shunting each one of the remaining lamps providing a sufficiently low impedance to a high frequency ignitor pulse that a substantial portion of said pulse first appears across a non-shunted lamp during lamp starting so as to start said non-shunted lamp and then, when the voltage across said non-shunted lamp falls, to impress a substantial portion of the same or a subsequent ignitor pulse across said shunted lamp to initiate its starting, wherein each capacitance is selected such that the phase of the ignitor pulse at each of the remaining lamps is different from any of the remaining lamps such that the voltage peaks across each of said lamps do not add together in real time; and said capacitance having a value sufficiently low to prevent current flow in the non-shunted lamp of sufficient magnitude as would cause premature lamp degradation due to sputtering of its electrodes when said shunted lamp is not on.

12. The ballast circuit of claim 11, wherein more than about 10% of said shunting capacitance across a lamp comprises the distributed capacitance between power-carrying conductors leading to said shunted lamp for powering said lamp.

13. The ballast circuit of claim 11, wherein substantially all of said shunting capacitance across a lamp comprises the distributed capacitance between power-carrying conductors leading to said shunted lamp for powering said lamp.

14. The ballast circuit of claim 11, wherein said high pressure lamps comprise at least one of, a metal halide lamp, a mercury lamp and a limited dose sodium lamp.

15. The ballast circuit of claim 11, wherein said ignitor circuit is so constructed as to produce an ignitor pulse of sufficient intensity and frequency that said plurality of serially connected lamps all start on the same ignitor pulse.

16. The ballast circuit of claim 11, wherein the shunting capacitance is between 2500 picofarads and 6000 picofarads.

17. The ballast circuit of claim 11, wherein the open ballast open circuit voltage has a 400 volt nominal rating ±10%.

18. A ballast circuit for at least two serially connected, high pressure gas discharge lamps, the circuit comprising:

an electromagnetic ballast arrangement receptive of an input power signal, providing an output ballast voltage for driving said plurality of lamps during steady state operation of said lamps, and providing an open circuit ballast voltage (OCV) when said lamps are disconnected from said arrangement;

an ignitor circuit for producing at least one ignitor pulse of high voltage and high frequency with respect to said open circuit ballast voltage, to initiate lamp starting;

a non-shunted lamp of the at least two lamps; and at least one phase shifting circuit configured to shunt the at least one remaining lamp acting to:

provide a sufficiently low impedance to a high frequency ignitor pulse so that a substantial portion of said pulse first appears across said non-shunted lamp during lamp starting so as to start said non-shunted lamp and then, when the voltage across said non-shunted lamp falls, to impress a substantial portion of the high frequency ignitor pulse across said shunted lamp to initiate its starting; and, provide sufficient phase shift of the OCV comprising reignition spikes at each of the remaining lamps such that the reignition spikes do not occur in the same phase at more than one lamp such that the voltage peaks across each of said lamps do not add together in real time.

19. The ballast circuit of claim 18, wherein more than about 10% of said shunting phase shifting circuit across a lamp comprises the distributed capacitance between power-carrying conductors leading to said shunted lamp for powering said lamp.

20. The ballast circuit of claim 18, wherein substantially all of said shunting phase shifting circuit across a lamp comprises the distributed capacitance between power-carrying conductors leading to said shunted lamp for powering said lamp.

* * * * *